United States Patent [19]

Charlier et al.

[11] Patent Number: 4,930,940

[45] Date of Patent: Jun. 5, 1990

[54] SYSTEM FOR GUIDING THE EXCAVATION TOOL USED FOR CONSTRUCTING A WALL CAST IN THE GROUND

[75] Inventors: Jacques Charlier, Ivry-sur-Seine; Paul Dupeuble, Noisy-le-Grand; Jean-Claude Gessay, Roissy-en-Brie, all of France

[73] Assignee: Sondages Injections Forages "S.I.F." Enterprise Bachy, France

[21] Appl. No.: 321,316

[22] Filed: Mar. 10, 1989

[30] Foreign Application Priority Data

Mar. 18, 1988 [FR] France ..... 88 03534

[51] Int. Cl.[5] ..... E02D 5/18; E02D 29/00

[52] U.S. Cl. ..... 405/267; 405/303

[58] Field of Search ..... 405/258, 266, 267, 282, 405/283, 303; 37/91

[56] References Cited

U.S. PATENT DOCUMENTS

| | | | |
|---|---|---|---|
| 2,526,176 | 10/1950 | Eyck . | |
| 3,513,572 | 5/1970 | Novet | 405/267 X |
| 3,645,101 | 2/1972 | Sherard | 405/267 |
| 3,796,054 | 3/1974 | Piccagli . | |
| 4,249,836 | 2/1981 | Schmednecht | 405/267 |

FOREIGN PATENT DOCUMENTS

| | | |
|---|---|---|
| 0101350 | 2/1984 | European Pat. Off. . |
| 2093090 | 8/1982 | United Kingdom . |

OTHER PUBLICATIONS

Patent Abstracts of Japan, vol. 9, No. 294, (M-431) [2017], Nov. 20, 1985 for JP-A-60 133 117, (Taisei Kensetsu K.K.), 16-07-1985.

*Primary Examiner*—David H. Corbin

*Attorney, Agent, or Firm*—Watson, Cole, Grindle & Watson

[57] ABSTRACT

The invention is concerned with civil engineering. It relates to a system for guiding the excavation tool used for making the trenches necessary for the construction panel-by-panel of a wall cast in the ground, which comprises, in combination, a vertical guide member extending over the height of the trench to be made and fixed to the adjacent panel or to a formwork located at the end of the adjacent panel, and guide wheels mounted on the excavation tool and rolling on the said member, said guide wheels being retained positively by the guide member relative to any horizontal force tending to separate them, and some wheel being profiled so as to be capable of destroying any obstacle of hardened concrete present on the guide member.

5 Claims, 2 Drawing Sheets

SYSTEM FOR GUIDING THE EXCAVATION TOOL USED FOR CONSTRUCTING A WALL CAST IN THE GROUND

The invention relates to a system for guiding the excavation tool used for constructing a wall cast in the ground.

Walls cast in the ground are produced by means of alternate or successive elementary panels. The finished structure thus consists of a succession of unitary panels of which there must be the possibility of guaranteeing the geometrical continuity during construction.

To ensure this geometrical construction continuity, two methods are used either independently or jointly.

The first involves giving the excavation tools (mechanical or hydraulic grabs for intermittent excavation and extraction of earth, or disc or chain cutters, or rotary milling cutters for continuous excavation and extraction) a body of great slenderness and of a cross-section closely approximate to the excavation cross-section, in order, in conjunction with the lowering of the centre of gravity, to achieve automatic guidance relative to the excavation work itself during construction. Monitoring and correcting devices can be incorporated in the excavation tools, so as to correct any deviation from the theoretical path more or less effectively.

The second involves guiding the excavation tool on the previously constructed panel more or less effectively. In the conventional wall construction method in general widespread use, the formwork installed at the end of the panel before concreting is extracted in the manner of sliding formwork, before the concrete has set completely. The cavity thus formed makes it possible to ensure a certain amount of guidance of the excavation tool at the moment of construction of the next panel.

Furthermore, European Patent No. 0,101,350 describes a specific process for extracting the end formwork by releasing it laterally, likewise making it possible, at the same time, to ensure the effective guidance of the excavation tool. However, the guide function of this device is subordinate to its simultaneous release, this being the primary object of the invention described. Furthermore, this guide process is based fundamentally on the sliding of two elements one in the other. Experience shows that for it to function correctly, albeit without completely preventing the risks of jamming and permanent blockage, it is necessary to adopt a dynamic mode of operation, for example by a to-and-fro movement or swinging of the excavation tool, in view of the adverse conditions prevailing in the medium which is heavily laden with solid particles in suspension coming from the soil and in which the entire assembly is immersed. This system is therefore perfectly suitable when grab buckets are used as an excavation tool, but is completely inappropriate when continuous excavation tools, such as wall cutters and milling cutters, are used.

Finally, U.S. Pat. No. 3,513,572 makes known a system for guiding an excavator of the grab type, according to which the superstructure of the excavator carries guide wheels which are located at the lateral ends of the said superstructure and which roll on guide piles suitably positioned in the ground at the two ends of the trench to be made, before the excavation work is carried out. The disadvantage of this system is that it makes it necessary for two strictly parallel piles to be positioned in the ground beforehand. This is difficult to carry out in practice, especially when the trench has to reach a great depth.

Now the use of cast walls for building civil engineering structures at increasing depths (which, for example, can exceed 100 meters) and in more and more difficult terrains has created the need for a construction technology which makes it possible from the outset to guarantee the geometry and continuity of the elementary component panels. The solutions currently available, which are acceptable up to a certain depth, are unsatisfactory for structures which are deeper or which require a higher degree of safety.

The object of the present invention is to provide a system for the effective guidance of the excavation tool during the entire operation of digging an elementary trench.

More particularly, the invention relates to a system for guiding the excavation tool used for making the trenches necessary for the construction of a wall cast in the ground by means of successive or alternate panels, which comprises, in combination, a vertical guide member extending over the height of the trench to be made and fixed to a previously constructed adjacent wall panel or to a formwork installed at the end of the previously constructed adjacent panel, and guide wheels carried by the excavation tool and rolling on the said guide member, characterized in that:

(i) said guide member and said guide wheels are shaped and arranged in such a way that the said wheels are retained by said guide member counter to any horizontal force tending to separate them, and (ii) said wheels are profiled so as to be capable of destroying any obstacle of hardended concrete or slurry, possibly present on said guide member, in proportion as they roll on said member.

According to one embodiment, the guide member has, in cross-section, a T-shaped profile, the foot of which extends parallel to the length of the trench to be made and at its base is fixed to a previously constructed adjacent wall panel or to a formwork installed at the end of the said adjacent panel, and the system comprises at least two superposed pairs of guide wheels oriented substantially perpendicularly relative to said foot, the wheels of each pair being arranged on either side said foot, the wheels of the lower pair having their periphery profiled in the form of a central cutting disc and the wheels of the upper pair having their periphery profiled in the form of two lateral cutting discs separated by an intermediate groove.

According to an alternative version of this embodiment, the guide member has, in cross-section, an L-shaped profile, one of the branches of which extends parallel to the length of the trench to be made and at its base is fixed to a previously constructed adjacent wall panel or to a formwork installed at the end of the said adjacent panel.

Furthermore, advantageously, in order to make it easier for the profiled guide wheels to destroy any obstacle of hardened concrete or slurry present on the guide member, there is the possibility of coating a rubber-like material or a relatively easily destructible material onto those parts of the said member subjected to the action of the profiled wheels. The so formed coating constitutes a support which is deformable (where a rubber is concerned) or easily destructible (for example, where a brittle material is used) and which makes it much easier to eliminate obstacles of hardened concrete or slurry by means of the profiled wheels.

According to another embodiment, the guide member comprises a band which extends parallel to the length of the trench to be made and which is fixed to a previously constructed adjacent wall panel or to a formwork installed at the end of the said adjacent panel this band being pierced at regular intervals with through-slots, so as to form a rack and the system comprises at least one pair of guide wheels oriented substantially perpendicularly relative to said band, the wheels having teeth engaging said slots during the movement of the excavation tool along the guide member.

It should be noted that, in the abovementioned embodiments, the wheels of each pair can be at the same height as or slightly offset relatively to one another. Also, the system can include additional pairs of guide wheels arranged above the pairs described above. However, these additional wheels need not be profiled on their periphery and can therefore have a conventional plane running tread.

The system according to the invention is especially advantageous when the excavation tool is a cutting machine working by continuous excavation. It can also be used when the excavation tool is a grab-type machine working by intermittent excavation. In the following description, the invention will be described more particularly in relation to the use of a cutting machine as an excavation tool.

The following description made with reference to the accompanying drawings will make it easy to understand the present invention.

Figure 1:
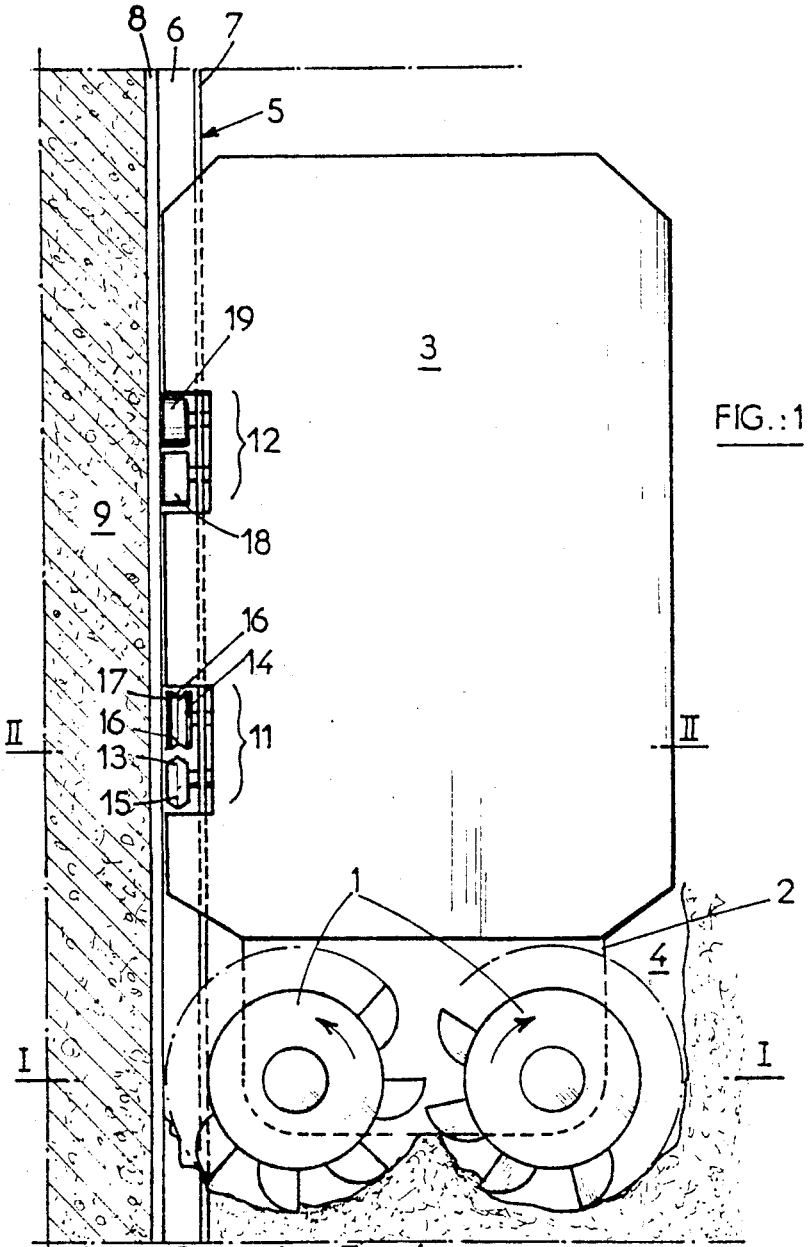
FIG. 1 is a partially cut-away diagrammatic side elevation view illustrating the guide system of the invention.
Figure 2:
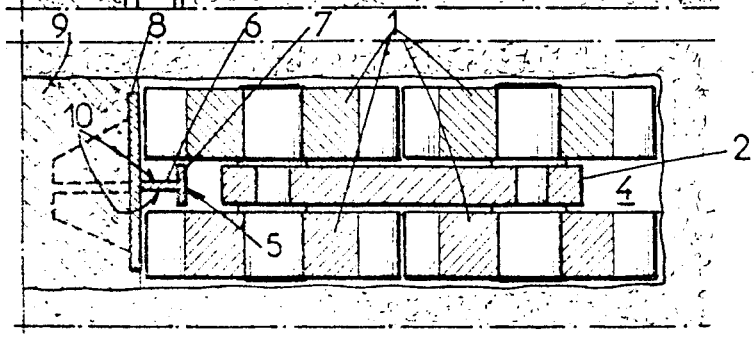
FIGS. 2 and 3 are diagrammatic sectional views along the respective lines I—I and II—II of FIG. 1.
Figure 3:
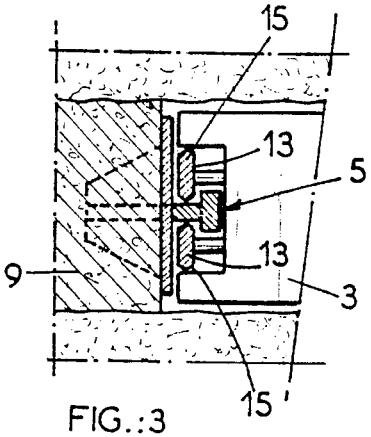

FIGS. 1 to 3 show a wall cutter comprising four cutting drums 1 of horizontal axis which are mounted in pairs on a central support 2 attached to the superstructure 3 of the machine, the two pairs of drums rotating in opposite directions. The four drums sweep over the whole of an area of rectangular horizontal projection, with the exception of a central strip 4 of a width corresponding to the location of the central support of the machine.

The guide system for the excavation tool comprises the various following elements:

a stationary guide rail 5 of T-shaped cross-section, installed in the axis of the previously constructed panel (FIG. 2). The bar 7 of the T, against the earth end, has a width of the same order as that of the central support of the cutting machine, so as to be capable of passing into the space present between the excavation drums.

According to the embodiment illustrated, at the base of the foot of the T this guide rail 5 is fixed to a temporary formwork 8 installed at the end of the previously constructed adjacent panel 9, over the entire length of the mid-generatrix of the latter. Alternatively, it would also be possible to design this guide rail as a lost rail, in which case it is fixed to a bedding element incorporated in the panel 9 itself.

The guide rail thus installed in the plane of symmetry of the panel defines two parallel longitudinal flutes 10 of opposite apertures, the common bottom of which is formed by the foot of the T.

Two superposed movable guide assemblies 11 and 12 fixed to the excavation machine along one of the edges of its superstructure and capping the guide rail 5 (FIG. 3).

Each guide assembly consists of two pairs of wheels of horizontal axis which are perpendicular to the foot of the T-shaped rail. The wheels of the same pair are mounted on either side of the foot of the T-shaped rail, so as to engage the two opposing flutes defined by the guide rail. The wheels of the same pair can be located at the same level, as shown, or be offset slightly in the vertical direction.

The lower guide assembly 11 is formed from two pairs of lower and upper wheels 13 and 14 profiled on their periphery. The lower wheels 13 are profiled in the form of a central cutting disc 15, whilst the upper wheels 14 are profiled in the form of two lateral cutting discs 16 separated by an intermediate groove 17 (FIG. 1).

The upper guide assembly 12 is formed from two pairs of lower and upper wheels 18 and 19, the running treads of which are plane.

Each pair of wheels thus opposes any horizontal movement of the machine, whether in its plane or in a perpendicular plane, allowing only vertical movement in a rolling motion along the guide rail.

At the moment of conceting of the previously constructed adjacent panel 9, concrete can bypass the temporary end formwork 8 by way of irregularities in the wall of the trench, enter the free volume present between the formwork and the earth and encase the guide rail, especially its foot.

The destruction of this possible bypassing concrete is obtained, on the one hand, by means of the excavation tool itself, of which the drums capping the guide rail and held at a predetermined and adjustable distance by the guide device, can as near as possible free the guide rail and the lateral surface of the panel 9. Where a lost guide rail is concerned, that is to say one without temporary end formwork, the same operation makes it possible to free the guide rail by accurately recutting the concrete of the end of the preceding panel 9.

The cleaning of the flutes of the guide rail so as to clear from them any filling of bypassing concrete is obtained by means of the wheels 13 and 14 of the lower guide assembly 11.

In fact, the wheels 13 of the lower pair, which are profiled on their periphery in the form of a central cutting disc, cause the disintegration of the concrete possibly present in the flutes 10 by punching over the whole length of a central furrow. This punching action is substantial because the weight of the excavation tool is considerable (several tonnes). The wheels 14 of the upper pair, which on their periphery are profiled in the form of two lateral cutting discs, complete the destruction of the filling concrete by means of the furrow generated by preceding discs. It will be seen that the cleaning of the guide flutes obviously arises only in respect of the lower movable guide assembly, the upper guide assembly travelling in freed flutes.

Figure 4:
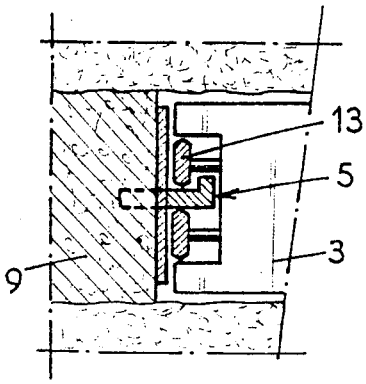
FIG. 4 is a diagrammatic cross-sectional view of an alternative embodiment of the guide member.

FIG. 4 illustrates an alternative embodiment of the guide rail. According to this alternative version, the rail 5 has, in the cross-section, the form of an L, one of the branches of which extends parallel to the length of the trench to be made. This alternative version is simpler to put into practice and is advantageous, more particularly, when a lost rail is used.

Figure 5:
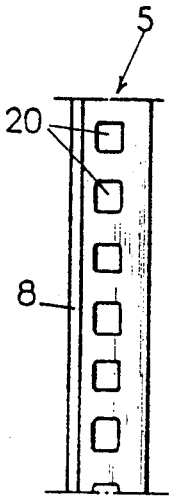
FIGS. 5 and 6 are respectively a diagrammatic side elevation view and end view of another embodiment of the guide system of the invention.
Figure 6:
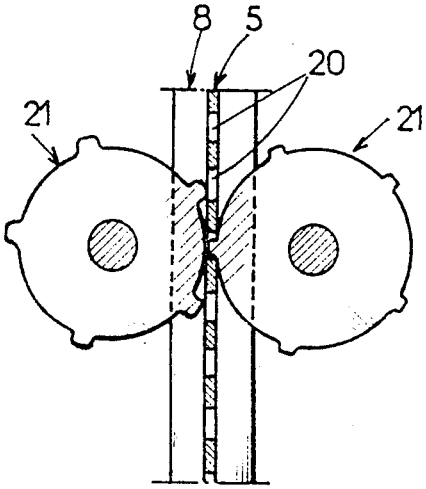

FIGS. 5 and 6 show another embodiment of the guide system of the invention. This embodiment differs from that of FIGS. 1–3 only in the type of guide rail and wheels of the lower guide assembly. According to this embodiment, the guide rail 5 consists of a simple band which extends parallel to the length of the trench to be made and which is pierced at regular intervals with through-slots 20, so as to form a sort of rack, and the lower guide assembly 11 is formed from a pair of gear wheels 21, the teeth of one of the wheels 21 being offset relative to the teeth of the other wheel, as illustrated, so as to engage into the said slots.

It should be noted that the rail 5 of the embodiment of FIGS. 5 and 6, instead of consisting of a simple band, could have a T-shaped cross-section, like the rail of the embodiment of FIGS. 1–3. Of course, in this case, it would be the foot of the T which would be pierced with slots.

This arrangement further improves the efficiency with which the concrete capable of encasing the guide rail is cleared. In fact, each tooth, when it engages into a slot, expels the concrete plug possibly blocking the slot. Advantageously, each slot is given a slight outward relief to make it easier to eliminate the debris.

Optionally, one or the two gear wheels can be driven by a rotary motor or rotary motors incorporated in the superstructure of the machine, in order to contribute to overcoming the frictional and rolling resistances and ensure the smooth functioning of the device, the motive force of the motor or motors being directed downwards. At the same time, this makes it possible to increase the vertical thrust on the excavation drums and therefore increase the excavation speed.

Figure 7:
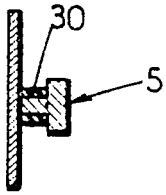
FIG. 7 is a diagrammatic view illustrating the use of a rubber-like coating on those parts of the guide member which are subjected to the action of the profiled wheels.

FIG. 7 illustrates the preferred embodiment in which the surfaces of the guide member 5 which are subjected to the action of the profiled wheels are covered with a rubber-like covering 30.

The above-described embodiments can also be used on intermittent excavation machines of the grab type, with the exception of the possible motorization of the guide gear wheels.

Where excavating grabs are concerned, the teeth equipping the leading edge of the bucket of the grab would cap the guide rail and clear the possible bypassing concrete, in the same way as the excavation drums of cutting machines.

It goes without saying that the embodiments described are only examples and that they could be modified, especially by substituting techical equivalents, without thereby departing from the scope of the invention.

In particular, the wheels ensuring the freeing of the flute or flutes of the guide rail from the concrete encasing it could be modified. For example, the wheels could be equipped, on their periphery, with other cutting tools, for example teeth, studs of tungsten carbide or other similar material.

We claim:

1. A system for guiding an excavation tool used for making trenches necessary for the construction of a wall cast in the ground by means of successive or alternate panels, comprising a vertical guide member extending over the height of the trench to be made and fixed to a previously constructed adjacent wall panel or to a formwork installed at an end of the previously constructed adjacent panel, and guide wheels carried by the excavation tool and rolling on said guide member, said guide member and said guide wheels being shaped and arranged in such a way that said wheels are retained by said guide member counter to any horizontal force tending to separate said wheels from said guide member, and said wheels are profiled so as to destroy any obstacle of hardened concrete or slurry, possibly present on said guide member, as said wheels roll on said guide member.

2. A system according to claim 1, wherein said guide member has, in cross-section, a T-shaped profile, the foot of which extends parallel to the length of the trench to be made and at its base is fixed to a previously constructed adjacent wall panel or to a formwork installed at the end of the said adjacent panel, and the system further comprises at least two superposed pairs of guide wheels oriented substantially perpendicularly relative to the foot, the wheels of each pair being arranged on either side of the foot, the wheels of the lower pair having their periphery profiled in the form of a central cutting disc and the wheels of the upper pair having their periphery profiled in the form of two lateral cutting discs separated by an intermediate groove.

3. A system according to claim 1, wherein the guide member has, in cross-section, an L-shaped profile, one of the branches of which extends parallel to the length of the trench to be made and at its base is fixed to a previously constructed adjacent wall panel or to a formwork installed at the end of the said adjacent panel, and the system further comprises at least two superposed pairs of guide wheels oriented substantially perpendicularly relative to the branch of the L-shaped guide member, the wheels of each pair being arranged on either side of the branch, the wheels of the lower pair having their periphery profiled in the form of a central cutting disc and the wheels of the upper pair having their periphery profiled in the form of two lateral cutting discs separated by an intermediate groove.

4. A system according to claim 1, wherein said guide member comprises a band which extends parallel to the length of the trench to be made and which is fixed to a previously constructed adjacent wall panel or to a formwork installed at the end of the said adjacent panel this band being pierced at regular intervals with through-slots, so as to form a rack, and the system further comprises at least one pair of guide wheels oriented substantially perpendicularly relative to the said band, the wheels having teeth engaging the said slots during the movement of the excavation tool along the guide member.

5. A system according to claim 1, wherein the surfaces of the guide member which are subjected to the action of the profiled guide wheels are coated with a rubber-like material or with an easily destructible material.

* * * * *